2/26/85 OR 4,501,948

United States Patent [19]

Yampolsky et al.

[11] Patent Number: 4,501,948

[45] Date of Patent: Feb. 26, 1985

[54] METHOD AND APPARATUS FOR FORMING SPIRAL TUBING

[75] Inventors: Jack S. Yampolsky; Endre F. Peszeszer, both of San Diego, Calif.

[73] Assignee: GA Technologies Inc., San Diego, Calif.

[21] Appl. No.: 408,076

[22] Filed: Aug. 16, 1982

[51] Int. Cl.[3] ..... B23K 27/00

[52] U.S. Cl. ..... 219/121 LC

[58] Field of Search ..... 219/62, 121 LC, 121 LD, 219/121 EC, 121 ED; 228/17.7, 17, 145

[56] References Cited

U.S. PATENT DOCUMENTS

| | | | |
|---|---|---|---|
| 1,734,111 | 11/1929 | Bundy | 165/184 |
| 2,549,032 | 4/1951 | Taylor | 113/35 |
| 2,714,864 | 8/1955 | Fay | 113/35 |
| 2,991,740 | 7/1961 | Eckhardt | 113/35 |
| 3,030,488 | 4/1962 | Kuckens | 219/62 |
| 3,208,138 | 9/1965 | Eckhardt | 29/477.3 |
| 3,210,980 | 10/1965 | Sengel | 72/135 |
| 3,358,112 | 12/1967 | Timmers | 219/9.5 |
| 3,487,537 | 1/1980 | Lombardi | 29/477.7 |
| 3,546,910 | 8/1967 | Jensen | 72/49 |
| 3,601,570 | 8/1971 | Davis | 219/62 |
| 3,677,047 | 7/1972 | Holyoake et al. | 72/50 |
| 3,731,041 | 5/1973 | Gebauer | 219/62 |
| 3,818,740 | 6/1974 | Gebauer | 72/203 |
| 3,845,645 | 11/1974 | Gebauer | 72/12 |
| 3,997,098 | 12/1976 | Van Patten | 219/62 X |
| 4,247,033 | 1/1981 | Dahmen et al. | 219/62 X |

*Primary Examiner*—C. L. Albritton

*Attorney, Agent, or Firm*—Fitch, Even, Tabin & Flannery

[57] ABSTRACT

A method and apparatus for forming a spiral tube from a length of metallic strip material wherein the strip is fed through a closed tube forming die operative to form the strip into a spirally wound tube having its longitudinal edges in juxtaposed relation. Driven torque wheels carried on one or more support carriages downstream from the forming die are operative to engage the outer peripheral surface of the tube to prevent springback and enable selective control of the relation between juxtaposed edges of the strip as it is passed longitudinally through a welding station during which the juxtaposed edges are welded to form a continuous leak-proof seam. The metallic strip may be planar or have longitudinal flutes formed therealong.

9 Claims, 8 Drawing Figures

5.
120
118
118a
106
108b
130
132
110
132
110
106
104
128
100a
126
100b
92
100
100a
102a
90
90a
100
70a
70b
73
73
71a
74a
6.
72a
73
130
108a
102b
100
127
90a
71b
74b
102a
6.
73
72b
110
108a
92
90
90a
92
100a
102b
102a
110
106
110
104
120
118
118a
118a
118
120
130
66
66a
68a
5.
68b 80
82
73
71a
66b
12T
100
a
92
90
90a
66a
74a
96
71b
73
72b
82
80
74b 116
120
118
118a
114
130
110
108b
108a
18
106
114a
116a
116b
128
100
100a
126
96
90a
96a
92
90
74b
12T
102
116
110
104
102b
108a
108b
120
68b

METHOD AND APPARATUS FOR FORMING SPIRAL TUBING

BACKGROUND OF THE INVENTION

The present invention relates generally to apparatus for forming tubular conduit and the like, and more particularly to a novel method and apparatus for forming a generally straight spirally wound tube from metallic strip material having an uninterrupted helical welded seam therealong, the method and apparatus having particular application in the forming of relatively small diameter tubing from either flat or fluted strip stock.

Apparatus for forming spiral tubing from either flat or longitudinally fluted metallic strip material by forming the strip into a helically wound tubular configuration and securing helical abutting edges into a continuous seam are generally known. See for example, U.S. Pat. No. 3,601,570. The apparatus disclosed in U.S. Pat. No. 3,601,570 is relatively complex and is particularly suited for making relatively large diameter metallic pipe having either a smooth or corrugated helical wall by continuously welding abutting edges of the helically coiled strip to form a continuous butt-welded seam. Other spiral tube forming apparatus are known which form the helical seam by mechanically interlocking the juxtaposed edges of the metallic strip as it is formed into a generally cylindrical tube.

In the forming of spiral tubes from relatively thin metallic strip material which is either flat or has longitudinal flutes formed therealong, and wherein the diameter of the formed tube is to be relatively small, such as in the order of ½ to 2 inches, and the helical edges are to be secured by high speed welding utilizing a narrow welding arc, control of the relation between juxtaposed longitudinal edges of the strip during forming into a spiral tube is extremely important if uninterrupted leak-proof joints are to be achieved. Further, since the speed at which welding can be accomplished in the forming of spiral tubes is the primary factor in determining the production rate obtainiable from a spiral tube forming machine, high speed welding processes such laser welding and high frequency induction welding should be compatable with the tube forming machine.

In forming spiral tubes from relatively thin metallic strip material by feeding the strip material through a generally cylindrical bore in a forming die, the diameter of the tubing is a function of the internal diameter of the cylindrical bore and the angle between the axis of the bore and the direction of movement of the strip material as it is fed into the forming die. This angle determines the helix angle of the formed tube. As the strip material is formed into a helical tube within the forming die, the strip material undergoes a strain such that the spiral strip has a tendency to open up or spring back as it exits from the forming die. With the spiral tube being welded at a location downstream from the exit end of the forming die, it is particularly important that means be provided to prevent springback or opening of the spirally wound tube as it exits from the forming die and also enable control of the relationship between the juxtaposed edges of the wound strip so as to obtain an uninterrupted leak-proof weld seam.

SUMMARY OF THE INVENTION

A general object of the present invention is to provide a novel method and apparatus for forming spirally wound tube from relatively thin metallic strip material.

A more particular object of the present invention is to provide a novel method and apparatus for forming a spiral tube from a relatively thin metallic strip material which may be either flat or have longitudinal flutes formed therealong, the strip material being fed through a closed forming die operative to form a spiral tube after which a control torque is applied to the spiral tube by torquing control means in a manner to prevent springback and enable accurate control of the relationship betwen the juxtaposed longitudinal edges of the helically wound strip during welding of the juxtaposed edges to form an uninterrupted leak-proof seam.

In accordance with one feature of the present invention, a plurality of rotatably driven torquing wheels are supported downstream from the spiral tube forming die and are operative to engage the outer peripheral surface of the formed tube so as to prevent springback and effect accurate control of the juxtaposed edges of the spirally wound strip during welding to form an uninterrupted leak-proof seam.

Another feature of the spiral tube forming apparatus in accordance with the present invention lies in the provision of one or more carriages downstream from the tube forming die, each carriage supporting a plurality of rotatably driven torquing wheels circumferentially about the spiral tube so as to apply a torque to the helically wound strip in a direction to control the gap width at a welding station disposed downstream from the tube forming die.

Further objects, advantages and features of the present invention, together with the organization and manner of operation thereof, will become apparent from the following detailed description of the invention when taken in conjunction with the accompanying drawings wherein like reference numerals designate like elements throughout the several views.

DETAILED DESCRIPTION OF PREFERRED EMBODIMENTS

Figure 1:
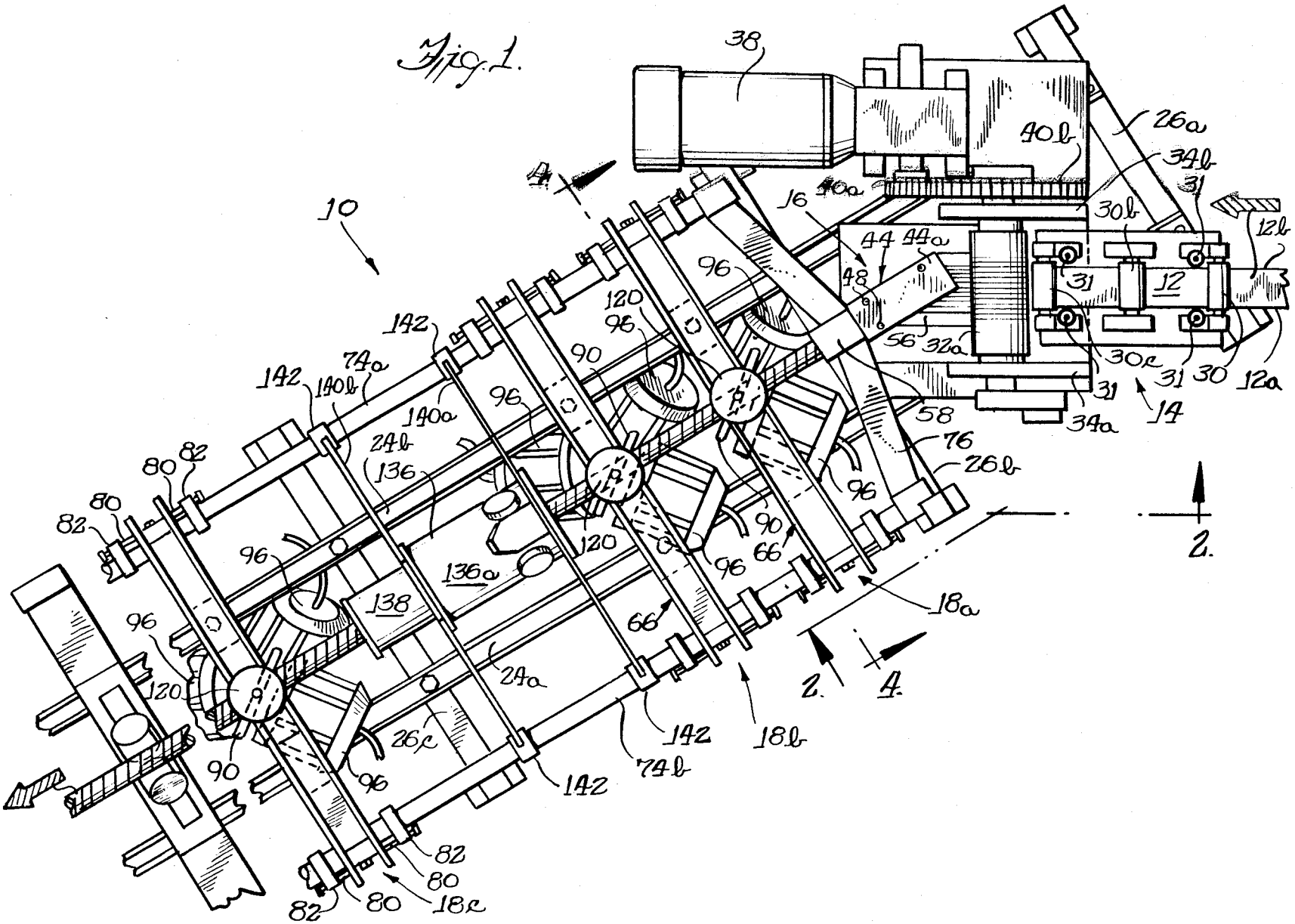
FIG. 1 is a plan view of an apparatus for forming spiral tubing in accordance with one embodiment of the present invention.
Figure 2:
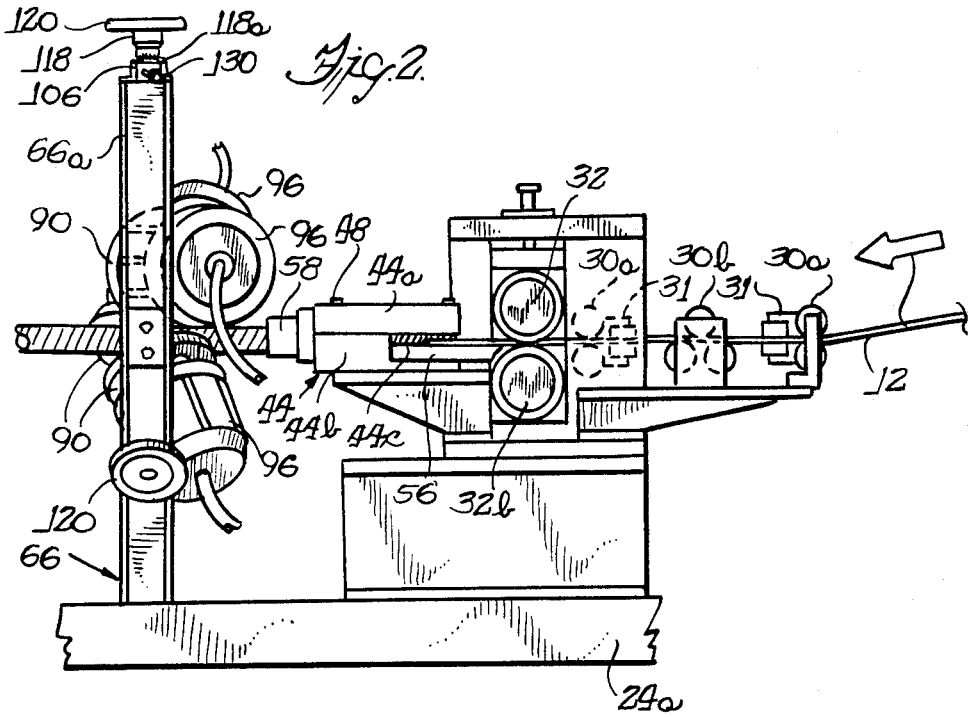
FIG. 2 is a fragmentary elevational view of the tube forming apparatus of FIG. 1, taken substantially along line 2—2 of FIG. 1 and looking in the direction of the arrows.

Referring now to the drawings, and in particular to FIG. 1, an apparatus or machine for forming spiral tubing in accordance with one embodiment of the present invention is indicated generally at 10. The apparatus 10 is adapted to form spiral tubing from a length of metallic strip material 12 having laterally spaced longitudinal edges 12*a* and 12*b* and which may be supplied from a suitable source such as a roll or coil (not shown) enabling the strip material to be drawn off and moved in the direction of its longitudinal axis. The strip material 12 may comprise a relatively thin metallic material, such as extruded aluminum 6061 stock or a suitable steel alloy, adapted to be formed into a spiral tube with its longitudinal edges 12*a* and 12*b* in juxtaposed relation so as to enable the edges to be selectively gapped or brought into abutting relation for high speed welding.

The strip material 12 is drawn from its supply roll or coil and passes through a feed station, indicated generally at 14. Prior to passing the strip 12 to the feed station 14, the strip material may have longitudinal flutes or corrugations formed therealong by conventional forming rolls or the like so as to provide a series of uniform parallel ridges and valleys of substantially equal size along the longitudinal length of the strip. The formed longitudinal flutes or corrugations may be formed in a manner to define a sine wave in transverse cross section and facilitate forming of a spiral tube as disclosed in U.S. Pat. No. 4,305,460.

The feed station 14 is operative to feed the metallic strip 12 through a tube forming station, indicated generally at 16, in a manner to form the metallic strip into a spirally wound tube as indicated at 12T. In the embodiment of FIG. 1, the spirally wound tube 12T passes from the forming station 16 through a series of substantially identical axially aligned and longitudinally spaced torquing stations, two of which are indicated generally at 18*a* and 18*b*. The torquing stations 18*a,b* are operative to restrain springback of the helically wound strip as it leaves the tube forming station 16 and also cooperate with a third torquing station 18*c* to control the relationship between the juxtaposed longitudinal edges 12*a*, 12*b* of the spirally wound strip preparatory to and during forming of a welded seam by means of a welding station, indicated generally at 20. In the embodiment of FIG. 1, the welding station 20 is disposed between the torquing stations 18*b* and 18*c* and receives the spiral tube downstream from the torquing station 18*b*. The welding station 20 is adapted for high speed welding of the juxtaposed longitudinal edges 12*a* and 12*b* of the spirally wound strip 12 so as to form a continuous leakproof weld. The torquing station 18*c* is substantially identical to the torquing stations 18*a* and 18*b* and cooperates particularly with the torquing station 18*b* to establish a predetermined gap or effect selective engagement between the juxtaposed edges 12*a,b* as the spiral tube passes through the welding station 20.

Turning now to a more detailed description of the various components of the tube forming apparatus 10, the feed station 14, tube forming station 16, torquing stations 18*a,b* and *c* and welding station 20 are supported in cooperative relation on frame means in the form of a pair of laterally spaced parallel support beams 24*a* and 24*b* which are secured to and supported by a plurality of transverse upstanding support frames, three of which are indicated at 26*a*, 26*b* and 26*c*. For purposes of illustration, a line drawn parallel to and centrally between the parallel support beams 24*a,b* defines the longitudinal axis of the tube forming apparatus 10 and establishes the direction of movement of the formed spiral tube 12T as it exits from the tube forming station 16 and passes through the torquing stations 18*a,b* and *c* and associated welding station 20.

Figure 3:
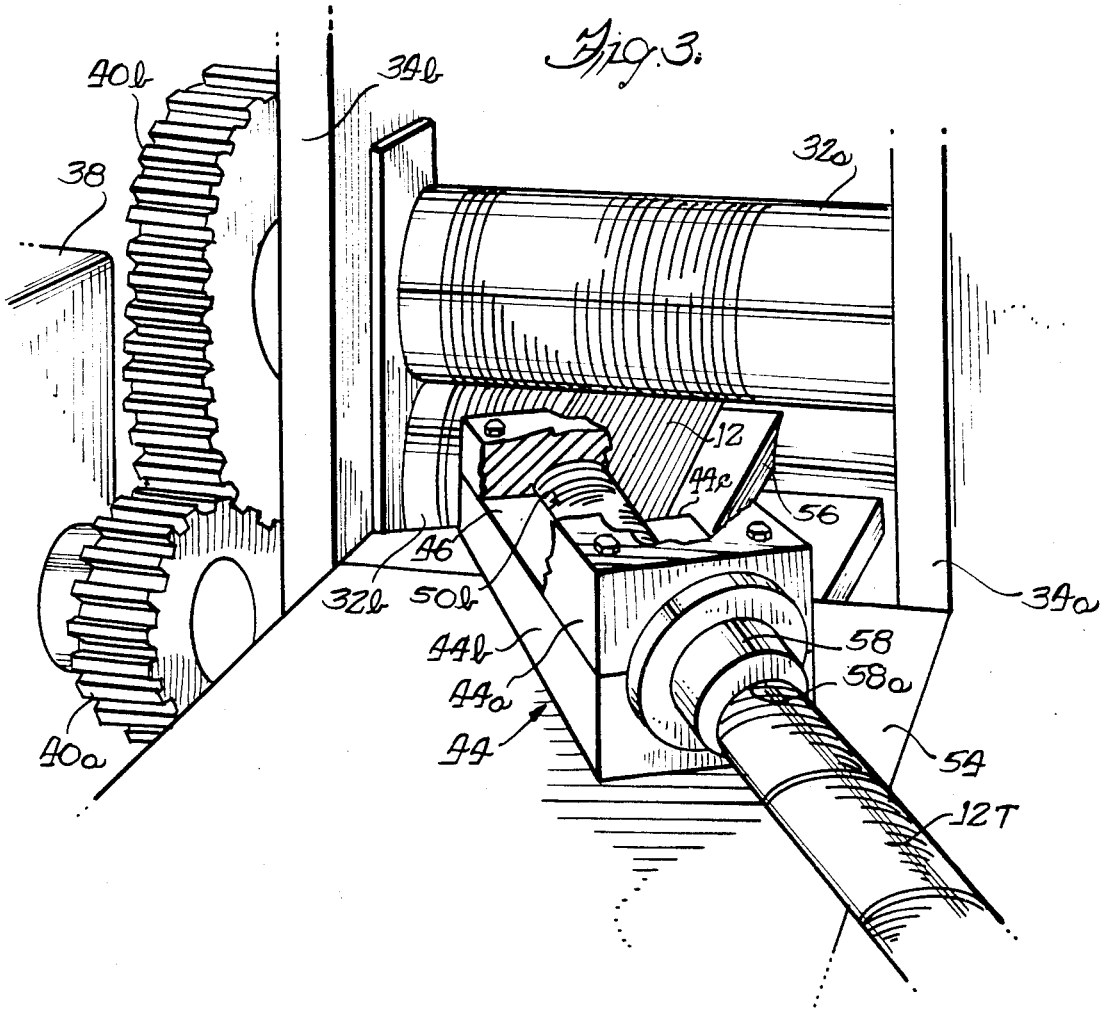
FIG. 3 is an enlarged fragmentary perspective view illustrating a longitudinally fluted metallic strip being fed from corrugated feed rolls into and through a tube forming die.
Figure 4:
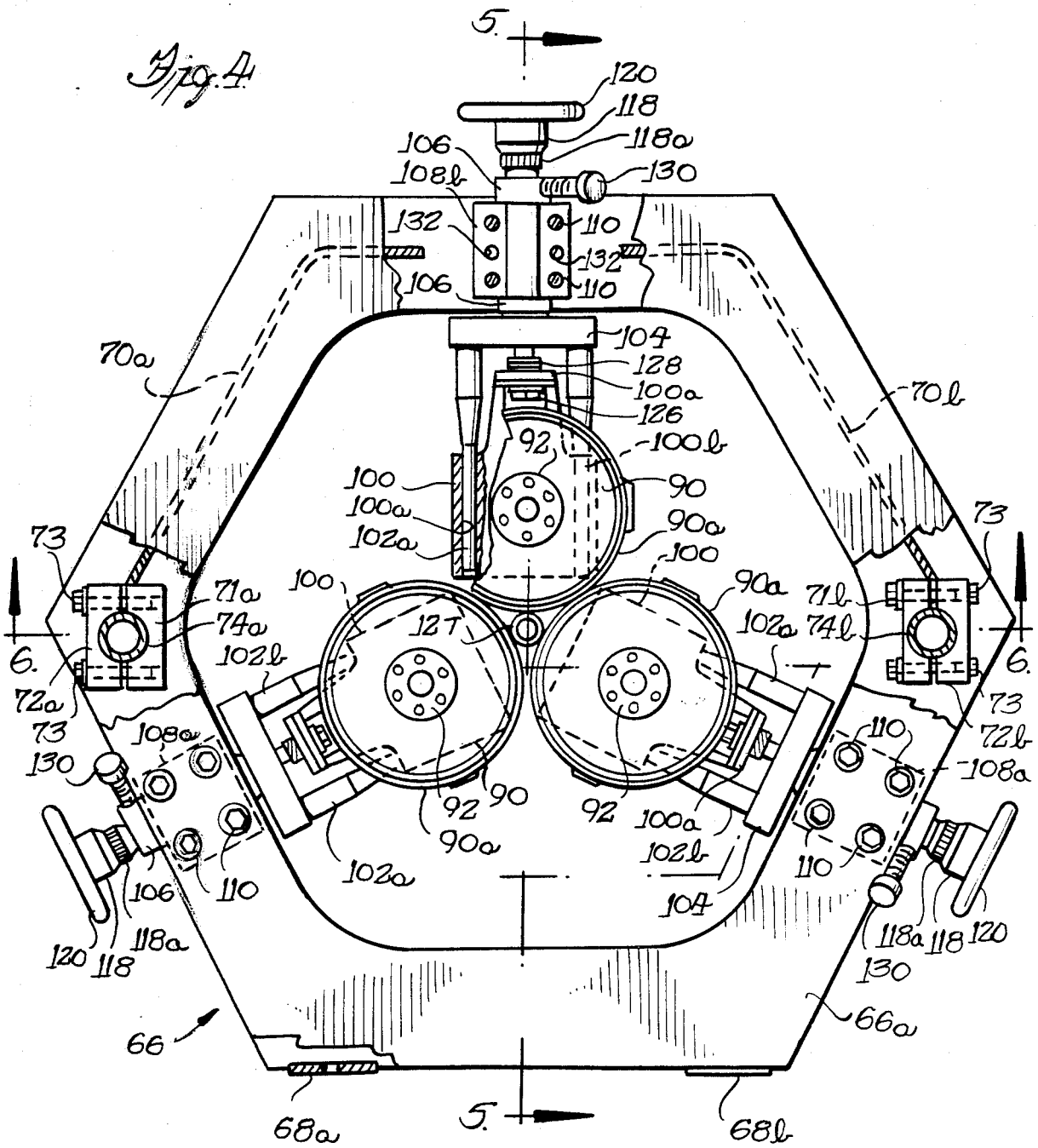
FIG. 4 is a fragmentary transverse sectional view, taken substantially along line 4—4 of FIG. 1, illustrating a representative one of the torquing stations with its torque wheels oriented so that their rotational axes are generally parallel to the axis of the associated spiral tube.

The feed station 14 includes sets of transverse idler rolls, the uppermost roll of each set being indicated at 30*a*, 30*b* and 30*c*, respectively, in FIG. 1. The strip 12 passes between the rolls of each set which cooperate with vertical axis laterally spaced guide rolls 31 to guide the strip between a pair of transverse equal diameter feed rolls 32*a* and 32*b* which, as best seen in FIG. 3, are journaled between upstanding support plates 34*a* and 34*b* so as to lie in vertically aligned parallel relation. In the illustrated embodiment, the feed rolls 32*a,b* have annular grooves or corrugations formed in their outer peripheral surfaces for mating cooperation with longitudinal flutes or corrugations formed along the length of the strip 12. At least one of the corrugated feed rolls 32*a,b*, such as the upper roll 32*a*, is rotatably driven by means of a drive motor 38 and suitable speed reducer means including spur gears 40*a* and 40*b* as illustrated in FIGS. 1 and 3. Means (not shown) of conventional design are provided to enable relative movement between the axes of the corrugating rolls 32*a,b* so to accommodate material strips 12 of different thicknesses while urging the feed rolls toward each other with sufficient force to maintain a positive feeding action on the strip.

Referring particularly to FIGS. 1 and 3, the feed rolls 32*a,b* are operative to feed the corrugated or fluted strip 12 into a closed tube forming die 44 located at the tube forming station 16. The tube forming die 44 is of generally rectangular configuration and has upper and lower die halves 44*a* and 44*b*, respectively, which define a planar parting plane 46 therebetween. The upper and lower die halves are releasibly connected by suitable means such as screws 48. Each of the upper and lower die halves 44*a* and 44*b* has a semicylindrical recess formed longitudinally thereof, such as indicated at 50*a* and 50*b*, respectively, which cooperate to define a cylindrical bore extending longitudinally through the tube forming die 44 when the die halves are in assembled relation. The diameter of the bore through the forming die is selected to establish the desired outer diameter of the spiral tube 12T to be formed.

The forming die 44 is suitably mounted on a generally horizontal support plate 54 such that the longitudinal axis of the tube forming bore subtends a predetermined angle with the longitudinal axis of the fluted strip material 12 as it is fed from the feed rolls 32*a,b*. The angular relation between the bore of the forming die and the axis of the strip 12 determines the helix angle of the spirally formed strip and therefore the helix angle of the juxtaposed longitudinal edges of the spiral strip which are to be welded together to form a continuous leakproof seam. To facilitate tangential entry of the strip 12 into the forming die 44, the lower die half 44*b* is relieved as at 44*c* (FIG. 3) to establish a tangential entry slot into the forming bore at an elevation substantially equal to the elevation of the nip formed between the feed rolls 32*a,b*. A support plate 56 is preferably supported to underlie the fluted strip 12 as it leaves the feed rolls 32*a,b* so as to guide the fluted strip tangentially into the cylindrical bore in forming die 44. Alternatively, transverse guide rolls (not shown) may be provided to receive the strip 12 from the feed rolls 32*a,b* so as to prevent buckling of the strip as it is fed into the closed forming die. An annular hub 58 is mounted on the tube forming die 44 at the exit end thereof and establishes a cylindrical discharge bore 58 coaxial with and of substantially equal diameter to the cylindrical bore defined by the semicylindrical recesses 50*a,b*.

As aforementioned, in the embodiment of the tube forming apparatus 10 illustrated in FIG. 1, the identical torquing stations 18*a* and 18*b* are positioned so as to lie between the tube forming station 16 and the welding station 20. With particular reference to FIG. 1, taken in conjunction with FIGS. 2 and 4–6, the torquing station 18*a* will be described as representative of all the torquing stations 18*a,b* and *c*. Each torquing station includes a generally hexagonal shaped frame 66 having a pair of frame plates 66*a* and 66*b* maintained in parallel spaced relation by rectangular mounting pads 68*a* and 68*b* secured to and between plates 66*a,b* at their lower edges, as by welding, and webs 70*a,b* and clamping blocks 71*a* and 71*b* fixed to and between the plates 66*a,b* as by welding. The clamping blocks 71*a,b* cooperate, respectively, with associated clamping blocks 72*a* and 72*b* through screws 73 to enable adjustable mounting of the support frames 66 on a pair of parallel longitudinally extending guide tubes or rods 74*a* and 74*b* the forward ends of which are supported by a transverse yoke 76 mounted on the annular hub 58 fixed on the exit end of the tube forming die 44. The tubular guide rods 74*a,b* facilitate selective longitudinal positioning of the torque stations 18*a,b* and *c* along the longitudinal axis of the tube forming apparatus with the centers of the hexagonal frames 66 in axial alignment with the axis of the spiral tube 12T exiting from the forming die 44.

As illustrated in FIG. 1, pairs of adjustment screws 80 are supported on the guide rods 74*a,b* through mounting brackets 82 which are fixed to the guide rods on opposite sides of each of the torque station frames 66. The screws 80 act on the frames 66 in a manner enabling finite positioning of the various torquing stations longitudinally along the guide rods 74*a,b*. The mounting pads 68*a,b* are adapted to be releasibly affixed to the frame beams 24*a* and 24*b* after positioning the torquing stations.

The support frame 66 of each torquing station 18*a,b* and *c* supports torquing means in the form of three substantially identical driven torque or drive wheels 90 supported in equidistantly circumferentially spaced relation about the geometrical center of the hexagonal frames. The torque wheels 90 are supported such that a peripheral drive surface 90*a* on each of the drive wheels engages the outer peripheral surface of the tube 12T. The drive surfaces 90*a* are made from suitable tread material such as urethane rubber having a durometer hardness of approximately 90. Each of the torque wheels 90 has a mounting hub 90 which facilitates mounting of the torque wheel on the drive shaft 94 of an associated drive motor 96 operative to effect driving rotation of the torque. In the illustrated embodiment, the drive motors 96 comprise hydraullic motors, such as commercially available from Nutron Company as its model DVT-10, which are connected to suitable hydraulic fluid lines to enable selective variable speed rotation of the associated torque wheels.

Figure 5:
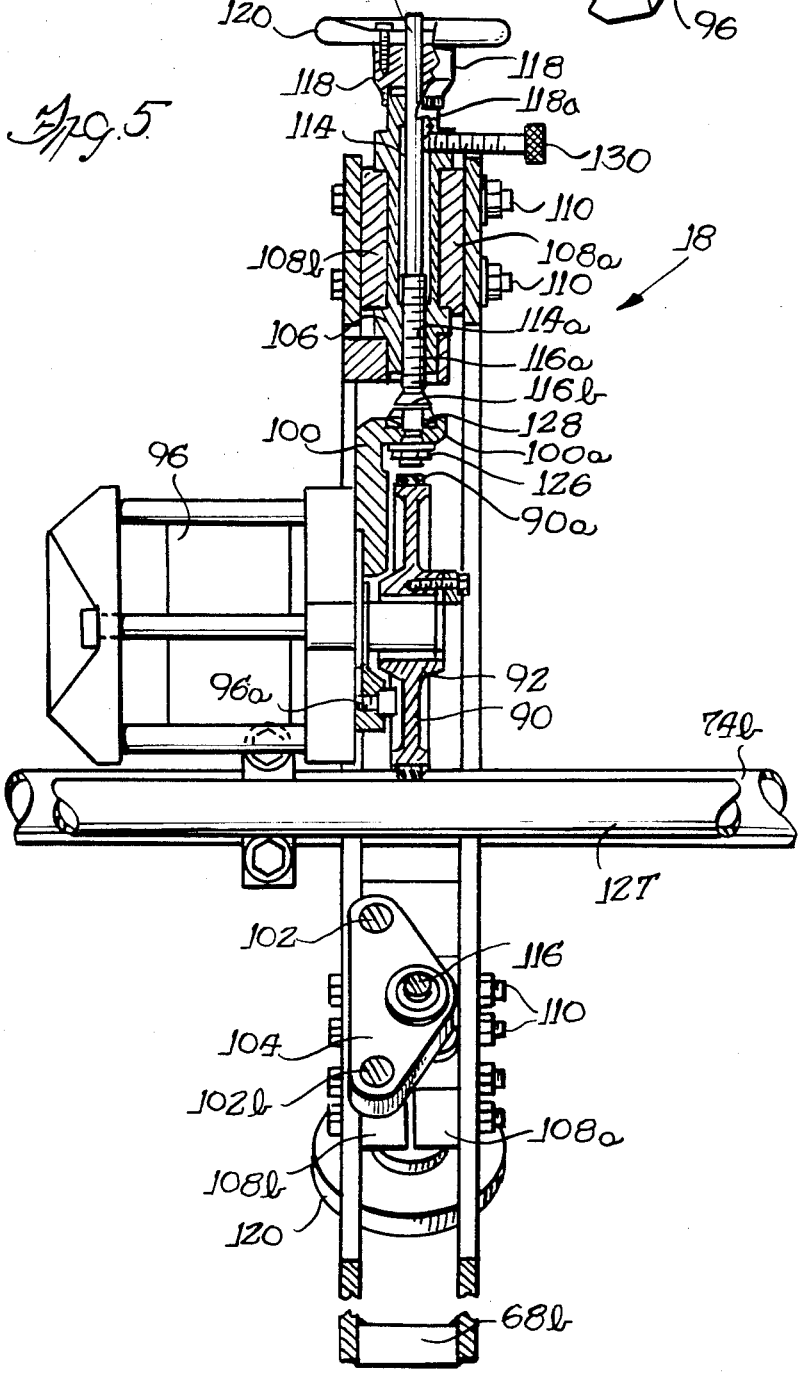
FIG. 5 is a fragmentary sectional view taken substantially along line 5—5 of FIG. 4, looking in the direction of the arrows.

To enable adjustment of the pressure contact between the peripheral drive surfaces 90*a* on the torque wheels 90 and the outer peripheral surface of the spirally wound tube 12T, each of the torque wheels 90 and its associated drive motor 96 is mounted on a support block 100 by screws, one of which is indicated at 96*a* in FIG. 5, for selective radial adjustment relative to the axis of the tube 12T. Each of the slide blocks 100 has a pair of parallel cylindrical bores 100*a* and 100*b* formed therethrough which receive cylindrical parallel guide rods 102*a* and 102*b* fixed on a support plate 104. Each support plate 104 is secured on the inner end of an annular support member 106 which is supported by and between a pair of mating support blocks 108*a* and 108*b* fixed to and between the associated frame members 66*a* and 66*b* by screws 110, as illustrated in FIG. 5. The support member 106 has a generally cylindrical bore 114 formed longitudinally therethrough the lower portion of which is internally threaded at 114*a* for threaded engagement with an external thread 116*a* formed on a radially disposed adjustment screw shaft 116.

The outer end of each of the screw shafts 116 has an annular collar 118 fixed thereon to which is secured a handle 120 facilitating manual rotation of the screw shafts relative to their associated support members 106. Each of the adjustment screw shafts 116 has its inner end secured to a flange 100*a* on the corresponding guide block 100 through a nut 126 and compression washers 128 which are captured between the flange 100*a* and an annular flange 116*b* formed on the corresponding screw shaft. In this manner, rotation of the handles 120 in selected rotational directions is operative to move the corresponding torque wheels 90 radially relative to the spiral tube 12T to vary the pressure applied by the peripheral drive surfaces 90*a* against the spiral tube. To facilitate accurate incremental adjustment of the torque wheels 90 relative to the spiral tube 12T, each collar 118 preferably has a vernier scale 118*a* formed adjacent its lower edge for cooperation with an appropriate marking on the upper end of the associated support member 106 so as to provide a visual indication of the rotational position of the associated adjustment screw shaft 116 and thus the radial position of the corresponding torque wheel. Preferably, a locking screw 130 is cooperable with the upper end of each of the support members 106 and the associated screw shaft 116 to enable locking of the screw shafts 116 in selected position.

Figure 6:
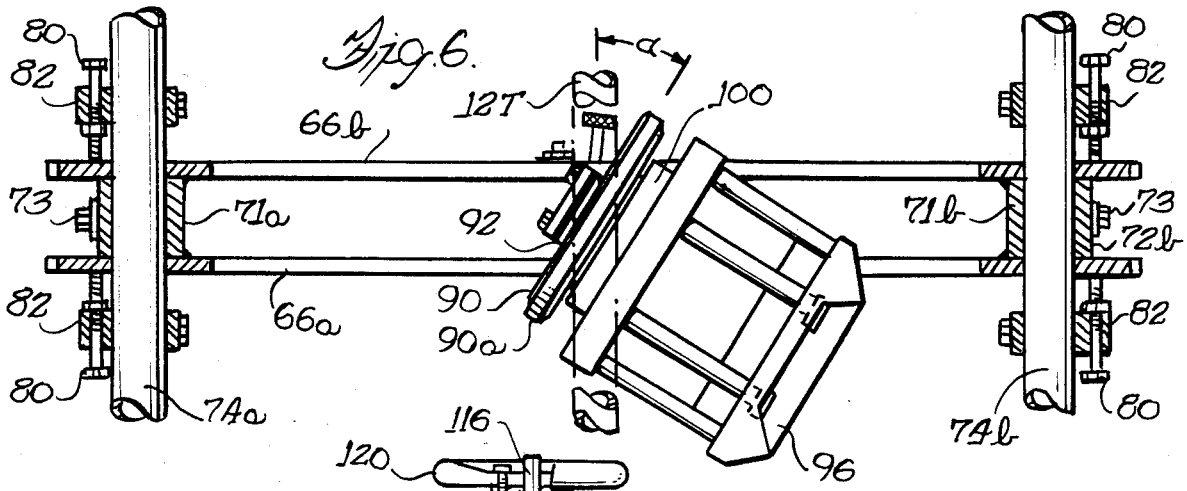
FIG. 6 is a fragmentary sectionial view taken substantially along line 6—6 of FIG. 4, but with the torque wheel shown in its normal angular relation to the spiral tube.
Figure 7:
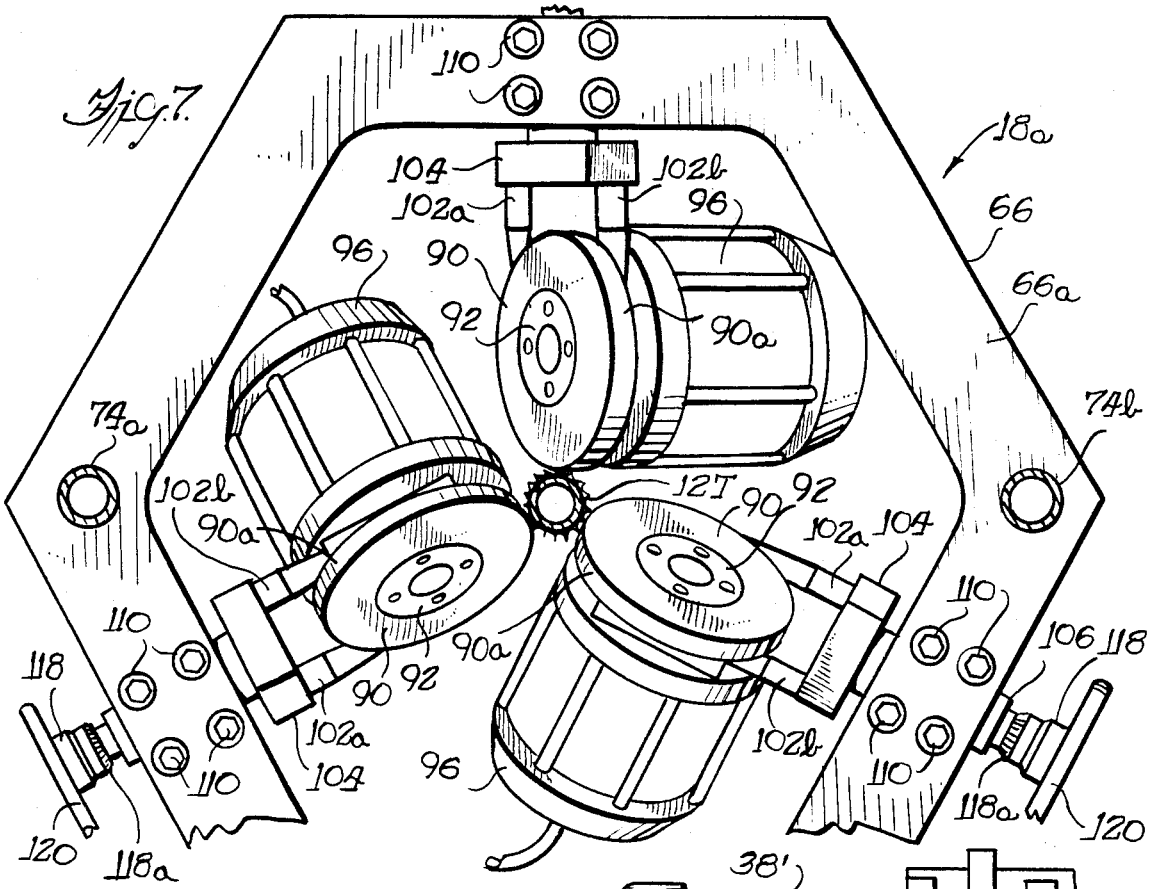
FIG. 7 is a fragmentary view similar to FIG. 4 but showing the torquing rollers with their rotational axes in operative angled relation to the axis of the associated spiral tube.

In the operation of the tube forming apparatus 10, the torque wheels 90 are positioned so that their peripheral surfaces 90*a* engage the spirally formed tube 12T and apply a predetermined rotational torque thereto. FIGS. 6 and 7 illustrate a typical orientation of the torque wheels 90 and associated drive motors 96 of the torquing stations relative to the longitudinal axis of the spiral tube 12T. As illustrated in FIG. 6, each torque wheel 90 is positioned such that a median plane through the torque wheel and normal to its axis of rotation intersects the axis of the tube 12T and subtends an angle alpha therebetween of approximately 33 degrees, as considered in a horizontal plane containing the axis of tube 12T. The angular relationship alpha may be varied by loosening the screws 110 (FIG. 5) to allow rotation of the associated support member 106, support plate 104 and torque wheel relative to the corresponding frame 66. Preferably, pairs of spring receiving bores 132 (FIG.

4) are formed in the mating support blocks 108*a,b* to receive compression springs which assist in separating the support blocks to enable angular adjustment of the torque wheels when the screws 132 are loosened.

In the embodiment illustrated in FIG. 1, two torquing stations 18*a* and 18*b* are mounted on the guide rods 74*a,b* to receive the spiral tube 12T from the tube forming die 44. The torquing wheels 90 of the torquing stations 18*a* and 18*b* are adjusted to engage the tube 12T so as to prevent springback of the spirally wound strip as it exits from the tube forming die 44 and also exert a torque on the spiral strip 12T sufficient to maintain the juxtaposed longitudinal edges 12*a* and 12*b* of the sprially formed tube in abutting relation or with a predetermined gap therebetween. The number of torquing stations employed in forming a given spiral tube may be varied depending upon the material from which the tube is to be made and the diameter of the formed tube.

In the embodiment illustrated in FIG. 1, the welding station 20 is positioned just downstream from the second torquing station 18*b* and includes a welding carriage 136 and a weld inspection housing 138 supported by the welding carriage 136 in axial alignment therewith. The welding carriage 136 and weld inspection housing 138 are supported in axial alignment with the torquing stations 18*a–c* by transverse carriage supports 140*a* and 140*b* the opposite ends of which are secured to mounting sleeves 142 releasibly fixed to the guide rod 74*a,b*. The welding carriage 136 includes a generally annular housing 136*a* adapted to receive the tube 12T centrally therethrough. The housing 136*a* in the illustrated embodiment supports conventional tungsten inert gas welding means (not shown) for welding the juxtaposed edges 12*a* and 12*b* of the spiral tube 12T as the tube advances through housing 136*a*. Such welding means conventionally includes a tungsten tip electrode spaced a predetermined distance from the passing juxtaposed edges of the spiral tube so as to establish an arc, and includes means to shroud the weld area with an inert gas so as to form a continuous leak-proof welded seam. Alternative, laser welding means may be supported by the welding carriage housing 136*a* to effect high speed laser welding of the juxtaposed edges 12*a,b* of the spiral tube which are caused to abut each other at the point of welding.

The weld inspection housing 138 supports means of conventional design (not shown) for inspecting the welded seams formed by the welding carriage 136. Weld inspection may, for example, be accomplished by known ultrasonic or eddy current inspection techniques.

The torquing station 18*c* is mounted on the guide tubes 74*a,b* downstream from the welding station 20 and has its torque wheels 90 acting on the tube 12T so as to cooperate with torquing station 18*b* to control the relationship between the juxtaposed edges 12*a,b* of the spiral tube 12T as it passes through the welding carriage 136. The torque wheels 90 on the torquing station 18*c* also serve to maintain a torque on the welded tube immediately after welding and thereby reduce strain within the weld joint following welding.

Figure 8:
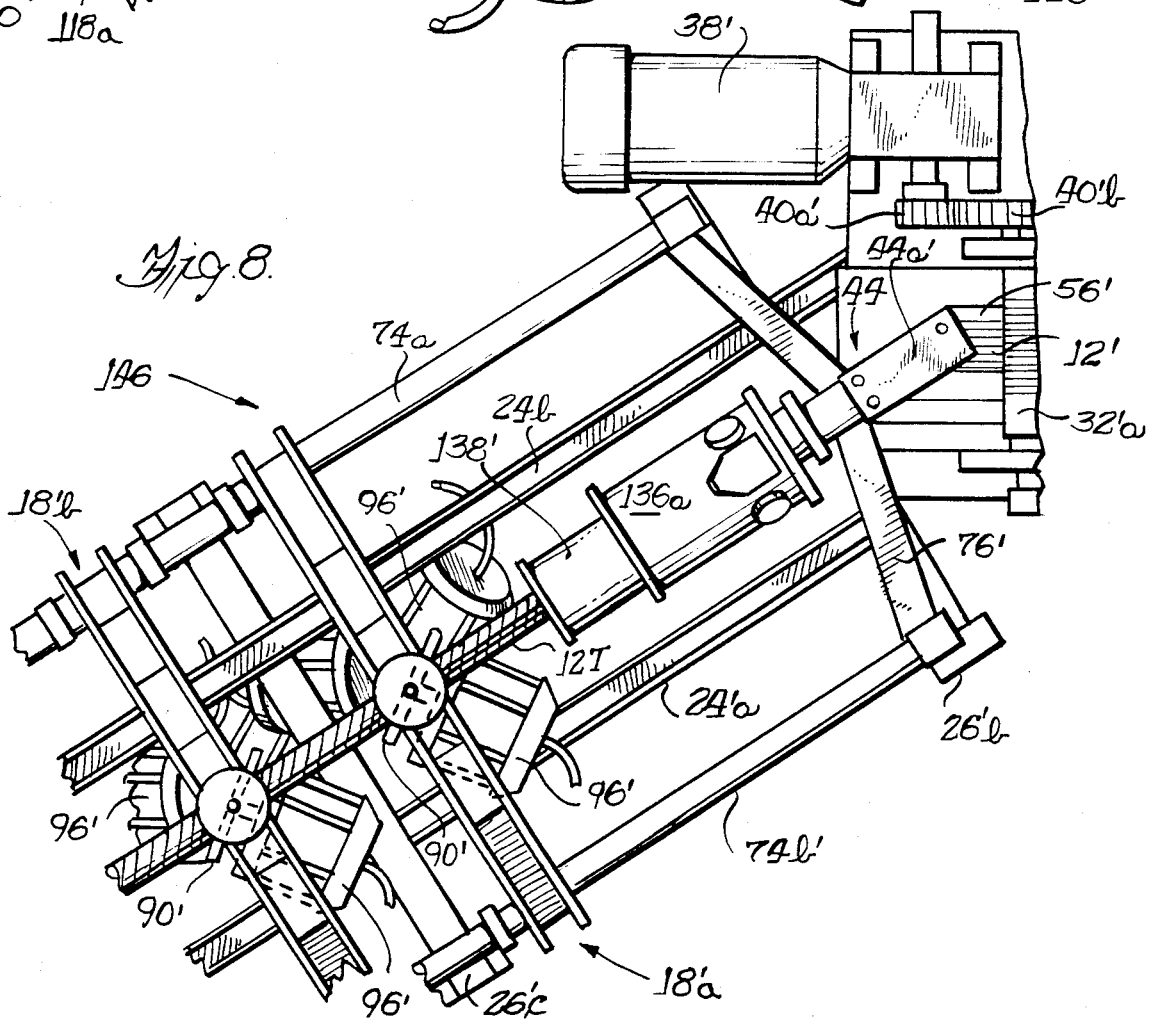
FIG. 8 is a fragmentary plan view of a tube forming apparatus in accordance with an alternative embodiment of the present invention.

FIG. 8 illustrates an alternative embodiment of a tube forming apparatus, indicated generally at 146, having a somewhat different arrangement of components than the aforedescribed tube forming apparatus 10. Elements in the tube forming apparatus 146 which are identical to corresponding elements in the tube forming apparatus 10 are identified with similar reference numerals having prime notation. The apparatus 146 differs from the aforedescribed tube forming apparatus 10 in the provision of a welding carriage 136' and an associated weld inspection housing 138' immediately adjacent the exit end of a closed tube forming die 44' so that the spirally wound tube 12T is welded immediately upon leaving the forming die 44' to form a continuous leak-proof helical seam. The welding carriage 136' may, for example, be mounted directly to the hub 58' on the tube forming die 44' which is supported in part by the transverse yoke 76'. Alternatively, it is envisioned that a welding electrode could be inserted through a suitable generally radial opening in the forming die 44 so as to weld the juxtaposed helical edges of the spirally formed tube simultaneously with forming of the tube.

Thus, in accordance with the present invention, a method and apparatus are provided for forming a spiral tube wherein a continuous metallic strip, either flat or having longitudinal flutes or corregations formed therealong, is fed through a tube forming die operative to form the strip into a helical or spiral tube the helix angle of which is determined by the angular relationship of the axis of the longitudinal bore in the tube forming die and the longitudinal direction or path of movement of the strip as it is fed into the tube forming die. The apparatus provides torquing stations downstream from the tube forming die which prevent springback of the spirally wound strip after forming into a spiral tube and maintain the juxtaposed edges of the formed tube in predetermined relation during passage through a welding station operative to weld the juxtaposed edges of the spiral tube to form a continuous leak-proof helical seam.

While preferred embodiments of the present invention have been illustrated and described, it will be understood to those skilled in the art the changes and modifications may be made therein without departing from the invention in its broader aspects. Various features of the invention are defined in the following claims.

What is claimed is:

1. Apparatus for forming spirally wound unperforated tube with an uninterrupted leakproof welded seam without flanges thereon from metallic strip material having parallel laterally spaced longitudinal edges, said apparatus comprising, in combination, frame means, tube forming die means supported by said frame means and defining a substantially cylindrical bore therethrough having an entrance end and an exit end, means for feeding a length of said metallic strip material into said entrance end of said die means in a direction such that the longitudinal axis of the strip subtends a predetermined acute angle with the axis of said bore, said feeding means being operative to advance said strip material through said cylindrical bore in a manner to form a spiral tube having said longitudinal edges in juxtaposed relation, said tube forming die means being of the closed tube kind including a cylindrical wall therein defining the substantially cylindrical bore for forming the tube solely by contact with said cylindrical wall, welding means supported by said frame means to receive said spiral tube from said die forming means and weld said juxtaposed edges so as to form an uninterrupted leakproof, continuous seam between said juxtaposed edges, and torquing means supported by said frame means and including a plurality of driven torque wheels adapted to apply a torque to said spiral tube in a manner to selectively control the relationship between said juxtaposed edges of said spirally wound tube during welding of said spiral tube, said torquing means comprising at least three torque wheels equally spaced about the circumference of said spiral tube and opposed to each other and having frictional contact with the spirally wound tube adjacent the closed tube forming die means to hold the longitudinal edges within the tube forming means and to reduce springback at the exit of the tube forming means and thereby reduce the force of the tube on the cylindrical wall forming the tube.

2. Apparatus as defined in claim 1 wherein each of said torque wheels has a peripheral drive surface thereon selectively positionable to engage the outer peripheral surface of said spiral tube, and drive means operatively associated with each of said torque wheels for effecting selective rotation thereof about its center axis.

3. Apparatus as defined in claim 2 wherein said torquing means includes frame means adapted to support a plurality of said torque wheels in substantially equidistantly circumferentially spaced relation about the axis of the spiral tube, and including means operatively associated with said frame means and said torque wheels and operative to enable generally radial adjustment of said torque wheels relative to the axis of said spiral tube.

4. Apparatus as defined in claim 3 wherein said radial adjustment means further includes means enabling adjustment of the angular relationship of said torque wheels relative to the axis of said spiral tube.

5. Apparatus as defined in claim 1 wherein said feeding means includes feed roll means adapted to feed said strip material in the direction of its longitudinal axis, said die means being positioned so that strip material enters said entrance end tangentially to said cylindrical bore.

6. Apparatus as defined in claim 1 wherein said torquing means includes a plurality of torquing stations disposed in longitudinal spaced relation along said frame means, at least one of said torquing stations being interposed between said tube forming die means and said welding means and operative to prevent springback of the helically wound strip as it exits from said exit end of said cylindrical bore, and at least one torquing station disposed downstream from said welding means and operative to apply a predetermined torque to the outer peripheral surface of the spiral tube so as to control the relation between said juxtaposed edges of said spiral tube during welding thereof.

7. Apparatus as defined in claim 2 wherein said drive means includes a hydraulic motor operatively associated with each of said torque wheels in a manner enabling driving rotation thereof.

8. Apparatus as defined in claim 1 wherein said tube forming die means comprises a substantially closed die having die halves releasibly connected and defining mutually cooperable generally semicylindrical recesses establishing said substantially cylindrical bore, said entrance end of said closed die being adapted to receive said metallic strip generally tangentially to said cylindrical bore.

9. A method for forming a spiral unperforated tube with an uninterrupted leakproof welded seam without flanges thereon from metallic strip material having parallel laterally spaced longitudinal edges, said method comprising the steps of;

feeding said metallic strip into a closed tube forming means having a wall defining a substantially cylindrical bore such that said strip enters said bore generally tangentially thereto and with the longitudinal axis of the strip subtending an acute angle with the longitudinal axis of said bore, and progressively advancing said strip through said bore so as to form said strip into spirally wound tube with said longitudinal edges in juxtaposed relation without the use of moving parts, applying a predetermined torque to the outer peripheral surface of said spirally wound tube from at least three driven torque wheels to hold the longitudinal edges within said tube forming means so as to reduce the force of the tube on the cylindrical wall and so as to prevent springback of the spirally wound strip after passing from said cylindrical bore and maintain said juxtaposed edges in predetermined relation to each other, and welding said juxtaposed longitudinal edges of said strip so as to form a substantially continuous seam along the length of said spiral tube and applying a predetermined torque to the welded seam.

* * * * *